US011131221B1

(12) United States Patent
Burke

(10) Patent No.: US 11,131,221 B1
(45) Date of Patent: Sep. 28, 2021

(54) CENTRAL VALVE FOR CAMSHAFT PHASER

(71) Applicant: Schaeffler Technologies AG & Co. KG, Herzogenaurach (DE)

(72) Inventor: Steven Burke, Fort Gratiot, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/997,466

(22) Filed: Aug. 19, 2020

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01)

(58) Field of Classification Search
CPC ..... F01L 1/3442; F01L 2001/34433
See application file for complete search history.

(56) References Cited

U.S. PATENT DOCUMENTS 5,209,194 A 5/1993 Adachi et al.
5,673,659 A 10/1997 Regueiro
9,267,399 B2 2/2016 Kohler et al.
2007/0095315 A1* 5/2007 Hoppe ..... F15B 13/0402 123/90.17
2018/0363512 A1* 12/2018 Ogura ..... F01L 1/047

FOREIGN PATENT DOCUMENTS

EP 1043482 A2 10/2000

* cited by examiner

*Primary Examiner* — Zelalem Eshete
(74) *Attorney, Agent, or Firm* — Matthew V. Evans

(57) ABSTRACT

A central valve for a camshaft phaser includes a hollow cylindrical housing, a hydraulic unit, a control piston, a retaining ring, and a washer. The hollow cylindrical housing includes a first radial opening and a groove. The hydraulic unit is disposed in the hollow cylindrical housing and includes a second radial opening and a channel. The control piston is axially moveable in the hydraulic unit to adjust a flow of a hydraulic medium through the first radial opening, the second radial opening, and the channel. The retaining ring is disposed in the groove to retain the hydraulic unit and the control piston in the hollow cylindrical housing. The washer is disposed in the hollow cylindrical housing axially between the hydraulic unit and the retaining ring.

17 Claims, 3 Drawing Sheets

CENTRAL VALVE FOR CAMSHAFT PHASER

TECHNICAL FIELD

The present disclosure relates generally to a valve, and more specifically to a central valve for a camshaft phaser.

BACKGROUND

Valves for camshaft phasers are known. One example is shown and described in commonly-assigned U.S. Pat. No. 9,267,399 to Kohler et al for a CONTROL VALVE OF A CAMSHAFT ADJUSTER, hereby incorporated by reference as if set forth fully herein.

SUMMARY

Example embodiments broadly comprise a central valve for a camshaft phaser including a hollow cylindrical housing, a hydraulic unit, a control piston, a retaining ring, and a washer. The hollow cylindrical housing includes a first radial opening and a groove. The hydraulic unit is disposed in the hollow cylindrical housing and includes a second radial opening and a channel. The control piston is axially moveable in the hydraulic unit to adjust a flow of a hydraulic medium through the first radial opening, the second radial opening, and the channel. The retaining ring is disposed in the groove to retain the hydraulic unit and the control piston in the hollow cylindrical housing. The washer is disposed in the hollow cylindrical housing axially between the hydraulic unit and the retaining ring.

In some example embodiments, the hydraulic unit includes an inner steel sleeve and a plastic over-molded outer shell. In an example embodiment, the plastic over-molded outer shell includes an axial slot forming the channel. In an example embodiment, the hollow cylindrical housing includes a notch and the plastic over-molded outer shell includes a radial tab disposed in the notch for positioning of the hydraulic unit in the hollow cylindrical housing.

In some example embodiments, the inner steel sleeve includes a first cylindrical end surface, the plastic over-molded outer shell includes a second cylindrical end surface aligned with the first cylindrical end surface, and the first cylindrical end surface and the second cylindrical end surface are flush with a first face surface of the washer. In an example embodiment, a second face surface of the washer, opposite the first face surface, is flush with a third face surface of the retaining ring.

In some example embodiments, the first cylindrical end surface includes a first inner diameter and the first face surface includes a second inner diameter, less than the first inner diameter. In some example embodiments, the control piston includes a body portion with a first outer diameter, and a control portion with a second outer diameter, greater than the first outer diameter and greater than the second inner diameter. In an example embodiment, the body portion and the control portion have a same control piston inner diameter.

In some example embodiments, the central valve has a check valve assembly. The plastic over-molded outer shell includes an axial cutout, and the check valve assembly includes an axial tab disposed in the axial cutout for rotationally positioning the check valve assembly relative to the hydraulic unit. In an example embodiment, the hydraulic unit is axially fixed in the hollow cylindrical housing between the check valve assembly and the washer.

In some example embodiments, the central valve has a pressure spring. The plastic over-molded outer shell includes an end portion with a radial wall, and the pressure spring is disposed axially between the radial wall and the control piston. In an example embodiment, the end portion includes an axially extending portion partially overlapping the pressure spring in an axial direction. In an example embodiment, the washer is a steel washer hardened by heat treating.

In some example embodiments, the hollow cylindrical housing includes a housing inner cylindrical surface, and the washer includes a washer outer cylindrical surface disposed proximate the housing inner cylindrical surface. In an example embodiment, the hydraulic unit includes a hydraulic unit outer cylindrical surface disposed proximate the housing inner cylindrical surface.

In an example embodiment, the hollow cylindrical housing includes a drive portion with a hexagonal periphery for receiving a tool for installing the central valve into a camshaft bore. In an example embodiment, the hollow cylindrical housing includes a threaded portion for threading the central valve into a camshaft bore. In an example embodiment, the retaining ring includes a retaining ring outer diameter, and a retaining ring inner diameter. The washer includes a washer outer diameter, less than the retaining ring outer diameter and greater than the retaining ring inner diameter, and a washer inner diameter, less than the retaining ring inner diameter.

DETAILED DESCRIPTION

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
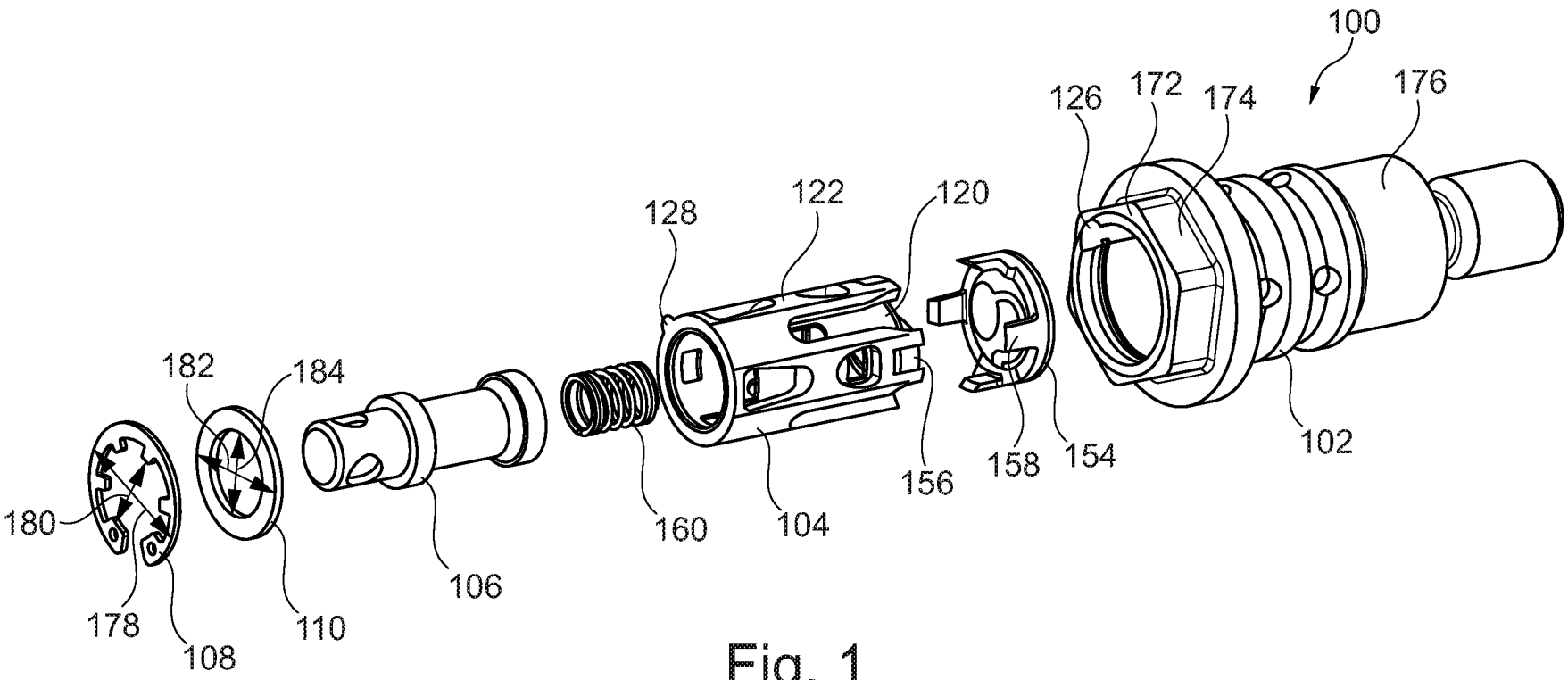
FIG. 1 illustrates an exploded view of a central valve according to an example embodiment.
Figure 2:
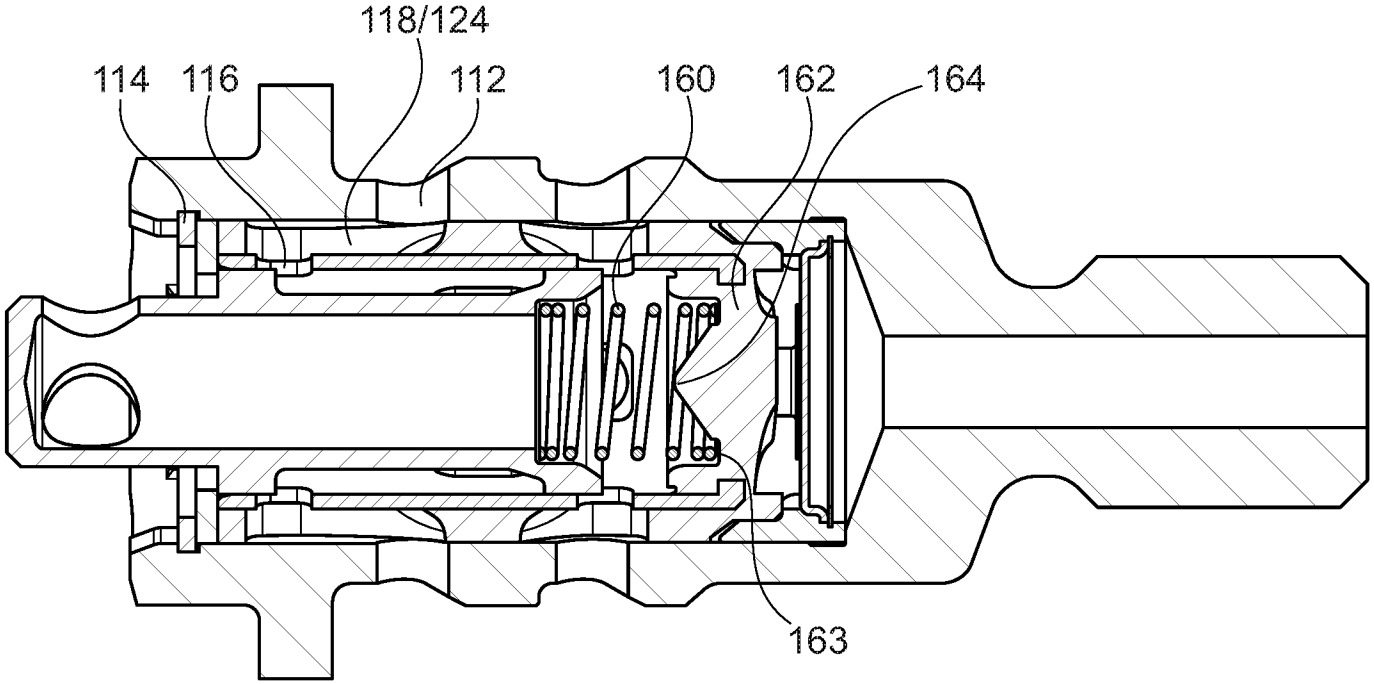
FIG. 2 illustrates a cross-sectional view of the central valve of FIG. 1.
Figure 3:
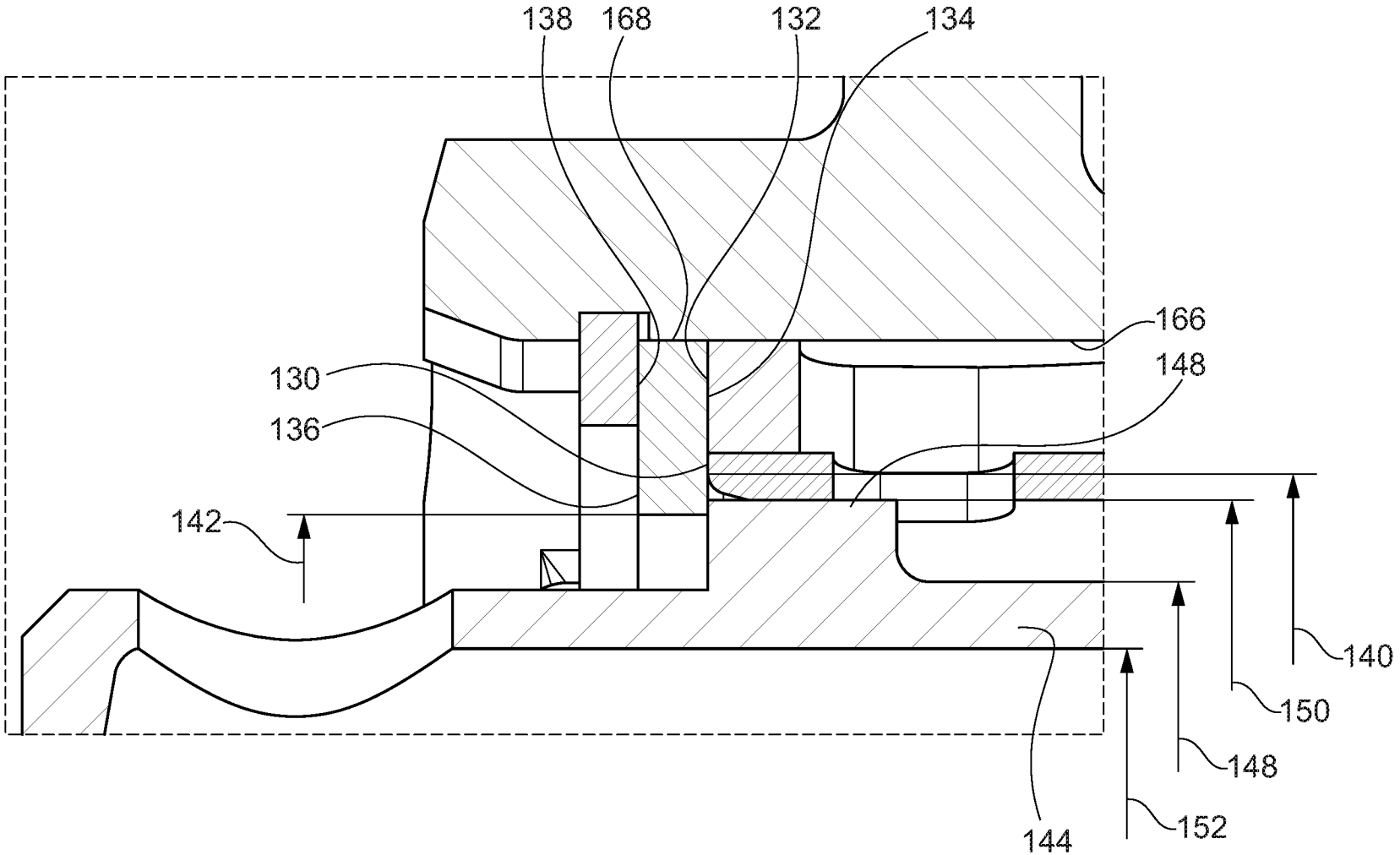
FIG. 3 illustrates a cross-sectional detail view of the central valve of FIG. 1.

The following description is made with reference to FIGS. 1-3. FIG. 1 illustrates an exploded view of central valve 100. FIG. 2 illustrates a cross-sectional view of central valve 100 of FIG. 1. FIG. 3 illustrates a cross-sectional detail view of central valve 100 of FIG. 1.

Central valve 100 for a camshaft phaser (not shown) includes hollow cylindrical housing 102, hydraulic unit 104, control piston 106, retaining ring 108, and washer 110. Housing 102 includes radial opening 112 and groove 114. The hydraulic unit is disposed in the hollow cylindrical housing and includes radial opening 116 and channel 118. Control piston 106 is axially moveable in the hydraulic unit to adjust a flow of a hydraulic medium through radial openings 112 and 116, and channel 118 as is known from the prior art. Central valve 100 may include a magnet (not shown) in the cylindrical housing for displacing the control piston. The retaining ring is disposed in the groove to retain the hydraulic unit and the control piston in the hollow cylindrical housing. The washer is disposed in the hollow cylindrical housing axially between the hydraulic unit and the retaining ring.

Hydraulic unit 104 includes inner steel sleeve 120 and plastic over-molded outer shell 122. The plastic over-molded outer shell includes axial slot 124 forming channel 118. Housing 102 includes notch 126 and outer shell 122 includes radial tab 128 disposed in the notch for positioning of the hydraulic unit in the hollow cylindrical housing.

Sleeve 120 includes cylindrical end surface 130 and outer shell 122 includes cylindrical end surface 132 aligned with surface 130. Surfaces 130 and 132 are flush with a face surface 134 of the washer. Face surface 136 of washer 110, opposite the face surface 134, is flush with face surface 138 of the retaining ring. Cylindrical end surface 130 includes inner diameter 140 and face surface 134 includes inner diameter 142, less than inner diameter 140.

Control piston 106 includes body portion 144 with outer diameter 146 and control portion 148 with outer diameter 150, greater than outer diameter 146 and greater than inner diameter 142. Body portion 146 and control portion 148 have a same control piston inner diameter 152.

Central valve 100 also includes check valve assembly 154. The plastic over-molded outer shell includes axial cutout 156 and the check valve assembly includes axial tab 158 disposed in axial cutout 156 for rotationally positioning the check valve assembly relative to the hydraulic unit. The hydraulic unit is axially fixed in the hollow cylindrical housing between the check valve assembly and the washer.

Central valve 100 also includes pressure spring 160. Plastic over-molded outer shell 122 includes end portion 162 with radial wall 164 and the pressure spring is disposed axially between the radial wall and the control piston. End portion 162 also includes axially extending portion 164 partially overlapping the pressure spring in an axial direction.

Washer 110 is a steel washer hardened by heat treating. Housing 102 includes housing inner cylindrical surface 166 and washer 110 includes washer outer cylindrical surface 168 disposed proximate the housing inner cylindrical surface. Hydraulic unit 104 includes hydraulic unit outer cylindrical surface 170 disposed proximate the housing inner cylindrical surface.

Hollow cylindrical housing 102 includes drive portion 172 with hexagonal periphery 174 for receiving a tool (not shown) for installing the central valve into a camshaft bore (not shown), and threaded portion 176 for threading the central valve into the camshaft bore. Retaining ring 108 includes retaining ring outer diameter 178 and retaining ring inner diameter 180. Washer 110 includes washer outer diameter 182, less than the retaining ring outer diameter and greater than the retaining ring inner diameter, and washer inner diameter 184, less than the retaining ring inner diameter.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

REFERENCE NUMERALS

100 Central valve
102 Hollow cylindrical housing
104 Hydraulic unit
106 Control piston
108 Retaining ring
110 Washer
112 Radial opening (first)
114 Groove
116 Radial opening (second)
118 Channel
120 Inner steel sleeve
122 Plastic over-molded outer shell
124 Axial slot
126 Notch
128 Radial tab
130 Cylindrical end surface (first)
132 Cylindrical end surface (second)
134 Face surface (first)
136 Face surface (second)
138 Face surface (third)
140 Inner diameter (first)
142 Inner diameter (second)
144 Body portion (control piston)
146 Outer diameter (first)
148 Control portion (control piston)
150 Outer diameter (second)
152 Control piston inner diameter
154 Check valve assembly
156 Axial cutout
158 Axial tab

160 Pressure spring
162 End portion
163 Radial wall
164 Axially extending portion
166 Housing inner cylindrical surface
168 Washer outer cylindrical surface
170 Hydraulic unit outer cylindrical surface
172 Drive portion
174 Hexagonal periphery
176 Threaded portion
178 Retaining ring outer diameter
180 Retaining ring inner diameter
182 Washer outer diameter
184 Washer inner diameter

What is claimed is:

1. A central valve for a camshaft phaser, comprising:
a hollow cylindrical housing comprising:
a first radial opening;
a groove; and
a notch;
a hydraulic unit disposed in the hollow cylindrical housing, the hydraulic unit comprising:
a second radial opening;
a channel;
an inner steel sleeve; and
a plastic over-molded outer shell having a radial tab disposed in the notch for positioning of the hydraulic unit in the hollow cylindrical housing;
a control piston axially moveable in the hydraulic unit to adjust a flow of a hydraulic medium through the first radial opening, the second radial opening, and the channel;
a retaining ring disposed in the groove to retain the hydraulic unit and the control piston in the hollow cylindrical housing; and
a washer disposed in the hollow cylindrical housing axially between the hydraulic unit and the retaining ring.

2. The central valve of claim 1, wherein the plastic over-molded outer shell comprises an axial slot forming the channel.

3. The central valve of claim 1, wherein:
the inner steel sleeve comprises a first cylindrical end surface;
the plastic over-molded outer shell comprises a second cylindrical end surface aligned with the first cylindrical end surface; and
the first cylindrical end surface and the second cylindrical end surface are flush with a first face surface of the washer.

4. The central valve of claim 3, wherein a second face surface of the washer, opposite the first face surface, is flush with a third face surface of the retaining ring.

5. The central valve of claim 3, wherein the first cylindrical end surface comprises a first inner diameter and the first face surface comprises a second inner diameter, less than the first inner diameter.

6. The central valve of claim 5, wherein the control piston comprises:
a body portion with a first outer diameter; and
a control portion with a second outer diameter, greater than the first outer diameter and greater than the second inner diameter.

7. The central valve of claim 6, wherein the body portion and the control portion have a same control piston inner diameter.

8. A central valve for a camshaft phaser, comprising:
a hollow cylindrical housing comprising a first radial opening and a groove;
a hydraulic unit disposed in the hollow cylindrical housing, the hydraulic unit comprising:
a second radial opening;
a channel;
an inner steel sleeve; and
a plastic over-molded outer shell having an axial cutout;
a control piston axially moveable in the hydraulic unit to adjust a flow of a hydraulic medium through the first radial opening, the second radial opening, and the channel;
a retaining ring disposed in the groove to retain the hydraulic unit and the control piston in the hollow cylindrical housing;
a washer disposed in the hollow cylindrical housing axially between the hydraulic unit and the retaining ring, and
a check valve assembly, having an axial tab disposed in the axial cutout for rotationally positioning the check valve assembly relative to the hydraulic unit.

9. The central valve of claim 8, wherein the hydraulic unit is axially fixed in the hollow cylindrical housing between the check valve assembly and the washer.

10. A central valve for a camshaft phaser, comprising:
a hollow cylindrical housing comprising a first radial opening and a groove,
a hydraulic unit disposed in the hollow cylindrical housing, the hydraulic unit comprising:
a second radial opening;
a channel;
an inner steel sleeve; and
a plastic over-molded outer shell having an end portion with a radial wall;
a control piston axially moveable in the hydraulic unit to adjust a flow of a hydraulic medium through the first radial opening, the second radial opening, and the channel;
a retaining ring disposed in the groove to retain the hydraulic unit and the control piston in the hollow cylindrical housing; and
a washer disposed in the hollow cylindrical housing axially between the hydraulic unit and the retaining ring; and
a pressure spring disposed axially between the radial wall and the control piston.

11. The central valve of claim 10, wherein the end portion comprises an axially extending portion partially overlapping the pressure spring in an axial direction.

12. The central valve of claim 10, wherein the washer is a steel washer hardened by heat treating.

13. The central valve of claim 10, wherein:
the hollow cylindrical housing comprises a housing inner cylindrical surface; and
the washer comprises a washer outer cylindrical surface disposed proximate the housing inner cylindrical surface.

14. The central valve of claim 13, wherein the hydraulic unit comprises a hydraulic unit outer cylindrical surface disposed proximate the housing inner cylindrical surface.

15. The central valve of claim 10, wherein the hollow cylindrical housing comprises a drive portion with a hexagonal periphery for receiving a tool for installing the central valve into a camshaft bore.

16. The central valve of claim 10, wherein the hollow cylindrical housing comprises a threaded portion for threading the central valve into a camshaft bore.

17. The central valve of claim 10, wherein:

the retaining ring comprises:

a retaining ring outer diameter; and a retaining ring inner diameter; and the washer comprises:

a washer outer diameter, less than the retaining ring outer diameter and greater than the retaining ring inner diameter; and a washer inner diameter, less than the retaining ring inner diameter.

* * * * *